United States Patent [19]

Fóth

[11] Patent Number: 4,750,733

[45] Date of Patent: Jun. 14, 1988

[54] AQUATIC AMUSEMENT DEVICE

[76] Inventor: István Fóth, Nystugan, S-680 51, Stöllet, Sweden

[21] Appl. No.: 865,345

[22] Filed: May 21, 1986

[30] Foreign Application Priority Data

Nov. 11, 1985 [SE] Sweden ..... 8504705

[51] Int. Cl.[4] ..... A63G 21/00; E04B 1/34; E04G 11/04

[52] U.S. Cl. ..... 272/56.5 R; 52/2

[58] Field of Search ..... 441/66, 67; 52/1, 4; 272/1 B

[56] References Cited

U.S. PATENT DOCUMENTS

| | | | |
|---|---|---|---|
| 1,564,313 | 5/1925 | Atger | 272/1 B |
| 3,176,982 | 4/1965 | Daniell | 272/1 B |
| 3,588,098 | 6/1971 | Stewart | 272/46 |
| 3,677,539 | 7/1972 | Bennet | 272/1 B |

OTHER PUBLICATIONS

Roger N. Dent, Principles of Pneumatic Architecture, 1971, pp. 108–116.

Thomas Herzog, Pneumatic Structures, 1977, p. 98.

*Primary Examiner*—Robert E. Bagwill
*Assistant Examiner*—Michael Brown
*Attorney, Agent, or Firm*—Murray and Whisenhunt

[57] ABSTRACT

Aquatic amusement device comprising a canvas held in an inflated configuration by a pneumatic overpressure inside a closed space under the canvas. The canvas has a top and a periphery and a trench full of water is provided along the canvas periphery. A support structure extends from the closed space up through the canvas supporting the canvas in the inflated configuration, with the canvas being supported in air-tight suspension from a suspension point some distance up the support structure. A water discharge device is provided on top of the support structure for directing water onto the canvas, and a water circulator is provided for circulating water from the trench in and under the canvas and along the support structure to the water discharge device. In this way, water exiting from the water discharge device flows by itself over the canvas back to the trench.

8 Claims, 2 Drawing Sheets

AQUATIC AMUSEMENT DEVICE

TECHNICAL FIELD

The invention relates to an aquatic amusement device comprising a canvas inflated by means of compressed air enclosed beneath the canvas to form an inflated body, the canvas defining the top restrictive surface of the inflated body. Preferably, the canvas is arranged above the level of the ground and means are provided for playing people to climb up on top of the inflated body and from there to slide down along the canvas into a water basin surrounding the inflated body.

BACKGROUND ART

In the U.S. Pat. No. 3,176,982 there is disclosed an amusement device comprising an inflatable dome, extending upwards from a base, said base preferably being at ground level. The base may also be located at the bottom of a pool or suchlike, the dome extending up above the surface of the water. This device permits the user to jump and bounce on the dome.

In the U.S. Pat. No. 3,677,539 there is disclosed an amusement device intended to float on the surface of some body of water. This device is in the form of an inflatable ball, and is provided with ropes hanging from the top of the ball, to be used to climb up on top of it.

In the U.S. Pat. No. 3,588,098 there is disclosed an amusement apparatus comprising a canvas, suspended from a mast extending through the top of the canvas. The point of attachment between the canvas and the mast is displacable along the mast, to make it possible to vary the tension of the canvas. The attachment point is connected to an annular element which may be turned by a user who is on the canvas, whereby the shape of the tensioned canvas may be varied.

SUMMARY OF THE INVENTION

The object of the present invention is to provide an aquatic amusement device which is provided not only with such elements as are known from the devices just described, but also with flowing water in a manner similar to what is the case with so called water chutes. It is also an object of the invention to provide an amusement device which may be used as a versatile ground for various forms to playing as well as for physical training under pleasant conditions for a considerably large number of people who may use the device at a time. Further, it is an object to provide a device which is comparatively easy to manufacture and to install and which may be comparatively big.

The amusement device according to the invention comprises a canvas (sheet) which is kept inflated by means of a pneumatic overpressure in a space beneath the canvas, the upper restriction of said space being said canvas. The invention is characterized in that there is provided a water-filled trench along the periphery of the canvas.

The canvas is preferably inflated to form a bell-like body, and the canvas extends down into the trench where it may form the bottom thereof. The canvas also should extend up past an outer edge, which is the peripheral boundary of the trench. Further, a mast or other useful support structure extends from said closed spaced up through the canvas, the canvas being attached to the mast at a predetermined height from the foot of the mast or corresponding support structure, the attachment being air tight. A part of the mast also should extend above the top of the canvas.

Water circulates from the trench in under the canvas, upwards inside or along the support structure, i.a. inside or along the mast according to a preferred embodiment, and from the top of the mast or corresponding member down onto the canvas, thence flowing by itself back to the trench. The top of the mast or corresponding support structure is provided with an umbrella-shaped roof, according to a preferred embodiment, off which the water flows down on all sides of the canvas. To make it possible for the people using the device to climb the inflated canvas a number of ropes or suchlike may be attached to the top of the support structure or to the top of the canvas itself and extend toward the trench. In a preferred embodiment the ropes also reach down into the trench and up over the outer edge thereof, where the other ends of the ropes are attached.

The closed space underneath the canvas may be accessible from the outside via an air-lock. The air-lock is preferably arranged in a tunnel which extends from the outside in under the trench and into the closed space.

The entire device is preferably circular or possibly oval with a relatively large diameter, and the trench surounding the canvas is in the form of a circular or oval, respectively, trench in the ground. The inner edge of the trench inclines slightly upwards toward the interior of the device, but does not touch the canvas as long as the canvas is inflated by the air pressure inside the closed space. Hence, under the canvas in the area adjacent to said inner edge of the trench there is a clearance which is edge-shaped in vertical sections, said edge-shaped clearance being defined by an annular water-filled part of the canvas and by the inner edge portion of the trench. Therefore, there is no risk that a person who slides down the side of the inflated canvas will hit the inner edge of the trench but instead the annular water basin will smoothly receive him.

The tunnel with the air-lock is preferably provided with an opening upwards to the ground outside the closed space and with an opening upwards to the ground inside the closed space. Further, the mast of corresponding support structure may formly be anchored to a concrete base in the ground inside the device.

The canvas also may be provided with transparent window-like portions, through which light may enter the closed space and through which it is possible to look at the players sliding along the outside of the canvas. The canvas may also be provided with elevations between which the players may slide.

The closed space may be used at will for rooms to change in, a restaurant, or other indoor activities. When people tread, jump and slide on the outside of the canvas, the inside will be highly vivid, which is most spectacular for people in the closed space.

BRIEF DESCRIPTION OF DRAWINGS

An embodiment of the invention will be described by way of an illustrative example. Reference will be made to the attached drawings, wherein.

DESCRIPTION OF A PREFERRED EMBODIMENT

Figure 1:
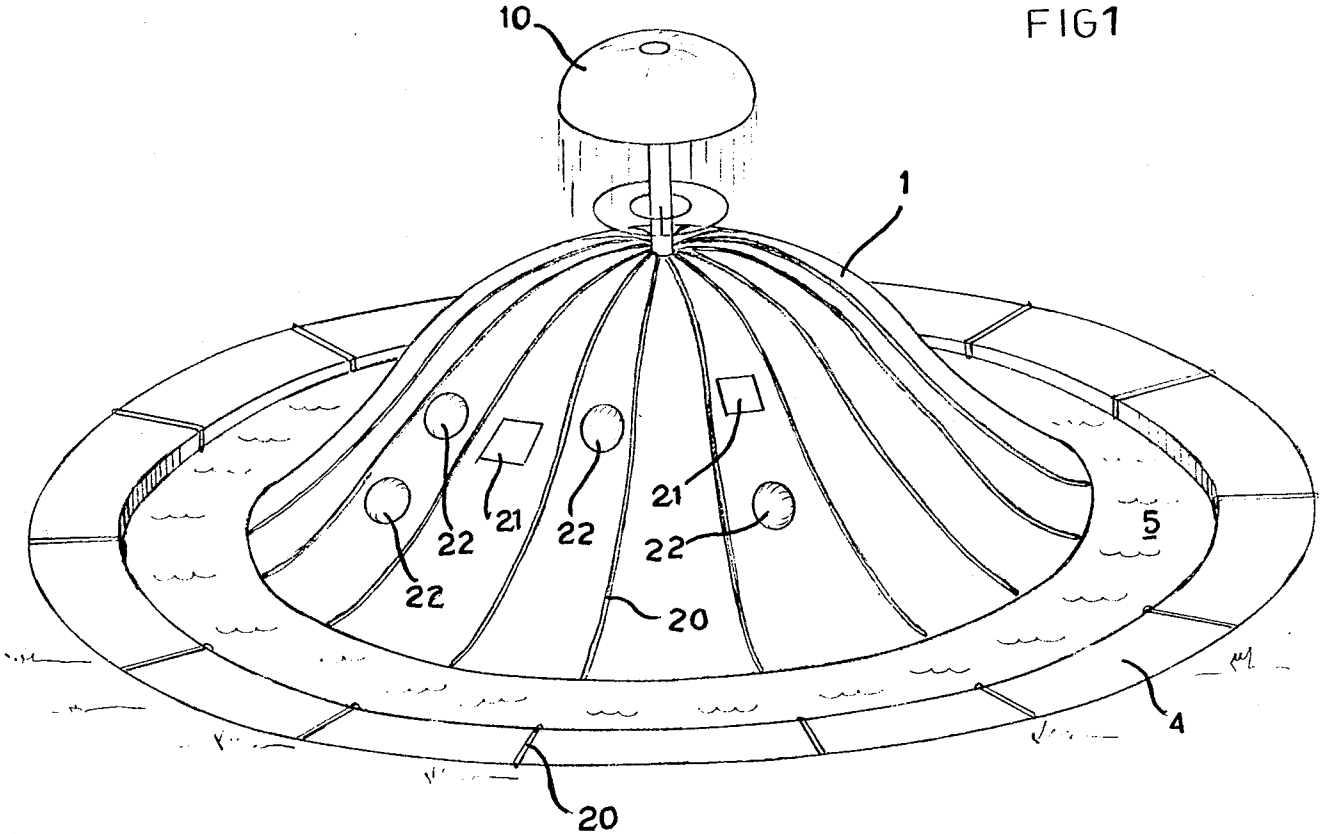
FIG. 1 is a perspective view of the device.

According to the preferred embodiment the device according to the invention comprises a watertight canvas 1, suitably made from PVC-coated fabric. Other kinds of fabric or material however may also be considered. The canvas 1 is circular. The peripheral part 2 of the canvas 1 extends down along the bottom of a trench 3, which surrounds the main part of the canvas 1 in the manner of a circular moat. The extreme edge of the canvas 1 is folded over the outer edge 4 of the trench 3. The trench is filled with water 5, securing the canvas 1 to the bottom of the trench 3.

In the ground there is a central concrete base 6. From this there extends a mast 7, which is tubular and extends through the centre of the canvas 1. The canvas 1 is suspended from the mast 7 at a height of four to five meters above the ground 8. The attachment of the canvas 1 to the mast 7 is airtight. A section 9 of the mast 7 extends above the top of the canvas 1 and at the very top of the mast 7 there is a small umbrella-like roof 10.

Figure 2:
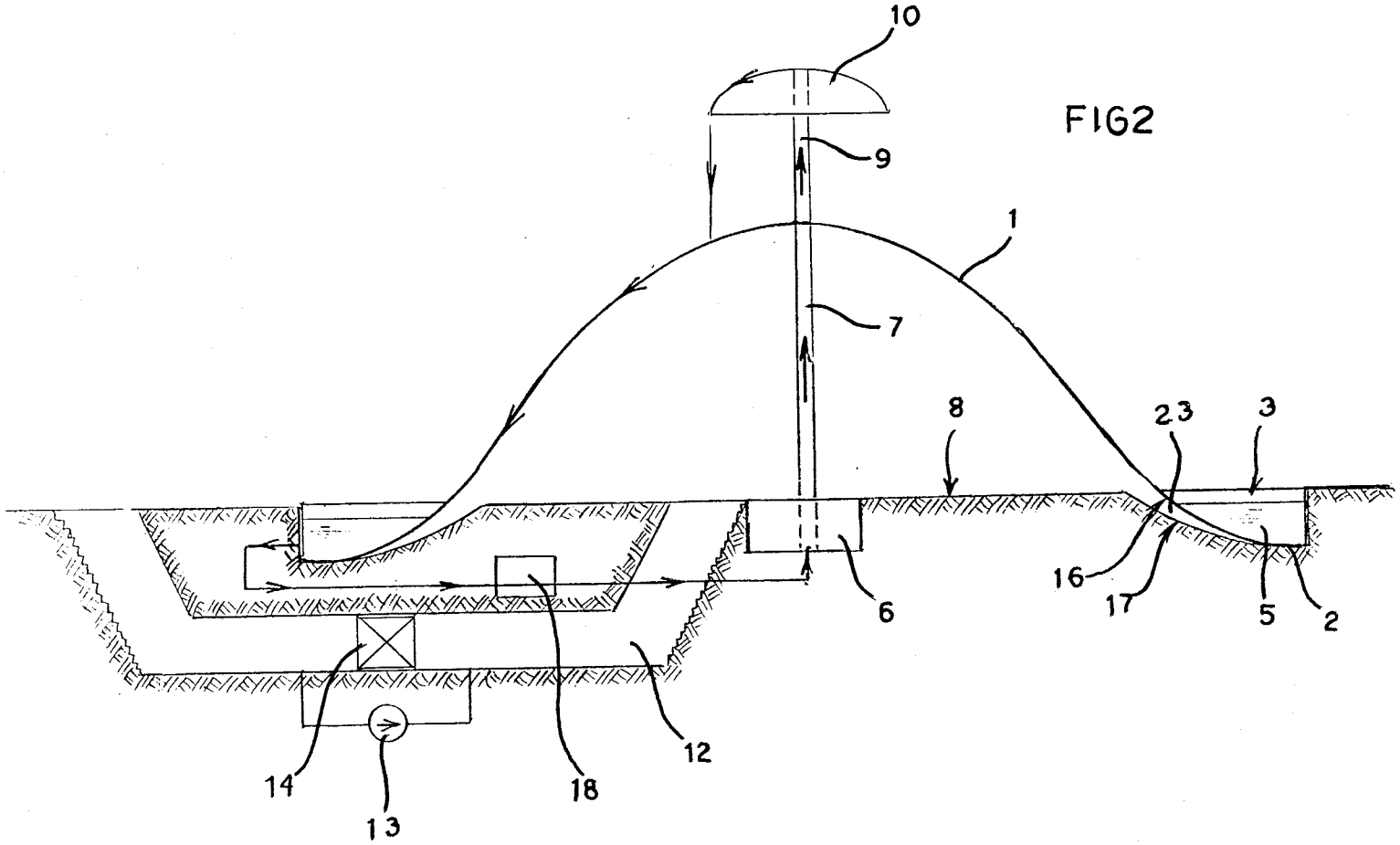
FIG. 2 is a vertical section of the device in FIG. 1.

The space 11 beneath the canvas 1, see FIG. 2, is accessible from the outside via a tunnel 12 which extends under the trench 3. The space 11 may be used for a restaurant or the like or for other activites. The space 11 is kept at superatmospheric pressure by means of an air pump, symbolically indicated at 13. By pumping air into the space 11 beneath the canvas 1, the canvas 1 is formed into the shape of a bell, as is schematically indicated in FIGS. 1 and 2. The tunnel 12 is provided with an air-lock 14. Due to the increased air pressure inside the space 11 the canvas 1 is raised somewhat near to the volume 5 of water, this area being designated 16, whereby the canvas in this area is lifted from the corresponding part 17 of the trench bottom, so that an annular clearance 23, which is wedge-shaped in a vertical plane of symmetry, if formed between the water-filled portion 16 of the canvas and the bottom portion 17 of the trench adjacent to the inner edge of the trench.

The water 5 in the trench 3 is kept at a constant level. Water is circulated from the trench 3 through a cleaning apparatus 18, in under the canvas 1, up through the tubular mast 7 and the top section 9 thereof and out over the umbrella-shaped roof 10, whence the water flows to all sides over the edge onto the canvas/bell, flowing down along the sides thereof, finally returning to the circular pool 5.

So as to make it possible for the people using the device to climb up on top of the "bell" a number of ropes 20 hang down from the top section 9 of the mast 7 down toward the trench 3, see FIG. 1. The pressure inside the space 11 is not great enough to stop the canvas 1 from flexibly yielding under the people treading on top of it and sliding along its sides. Because the volume of compressed air inside the canvas extends down in the form of the air pocket or clearance 23 above the portion 17 of the trench adjacent to the inner edge of the trench, people sliding down the canvas 1 will not hit the inner edge of the trench 2 but will slide smoothly into the water 5.

The extended canvas/bell 1 may also be provided with "windows" 21 of transparent plastic, which would further contribute to the entertainment of the people inside the space 11. The canvas 1 may also be provided with small elevations 22 at different places, which would make it possible to slalom down the incline.

The size of the device is not limited to any particular dimensions but the diameter of the device inside the trench 3 may suitably be between fifteen and twentyfive meters, and the width of the trench may for example be about four meters.

What is claimed is:

1. An aquatic amusement device, comprising:

a canvas held in an inflated configuration by a pneumatic overpressure inside a closed space under said canvas, wherein said canvas has a top and a periphery and wherein a trench of water is provided along said periphery of said canvas;

support means extending from said closed space up through said canvas for supporting said canvas in said inflated configuration, said canvas being supportd in airtight suspension from a suspension point a distance up said support means;

water discharge means on top of said support means for directing water onto said canvas; and circulating means for circulating water from said trench in under said canvas and along said support means to said water discharge means;

whereby water exiting from said water discharge means flows by itself over said canvas back to said trench.

2. A device according to claim 1, wherein said canvas is inflated to a shape of a bell, and wherein said canvas extends down into said trench.

3. A device according to claim 2, wherein said canvas extends down into said trench to constitute a bottom thereof and further extends over an outer edge, said outer edge being a periphery boundary of said trench.

4. A device according to claim 2, wherein an annular air pocket is provided between a portion of said canvas extending down into said trench and an inner edge portion of said trench, said annular air pocket being wedged-shaped in vertical sections of symmetry with the point of the wedge being directed outwards.

5. A device according to claim 1, wherein an upper section of said support means extends above said top of the canvas.

6. A device according to claim 5, wherein said upper section of said support means is provided with an umbrella-shaped roof, from which said water flows down onto said canvas.

7. A device as in claim 1, wherein said closed space is connected to outside of said canvas via an air-lock.

8. A device according to claim 7, wherein said air-lock is arranged in a tunnel extending from outside of said canvas under said trench and into said closed space.

* * * * *